US005239958A

United States Patent [19]

Booher

[11] Patent Number: 5,239,958

[45] Date of Patent: Aug. 31, 1993

[54] DELAY STROKE PISTON AND ROD FOR ENGINE

[76] Inventor: Benjamin V. Booher, 9868 E. Topaz, Scottsdale, Ariz. 85258

[21] Appl. No.: 928,880

[22] Filed: Aug. 11, 1992

[51] Int. Cl.[5] ..... F02B 75/32

[52] U.S. Cl. ..... 123/197.2; 123/197.3

[58] Field of Search ..... 123/197.2, 197.3, 48 B, 123/48 BA, 78 BA, 197.1; 74/579 E

[56] References Cited

U.S. PATENT DOCUMENTS

| | | | |
|---|---|---|---|
| 1,420,236 | 6/1922 | Bohman | 123/197.4 |
| 2,194,022 | 3/1940 | Kitzeman | 123/78 B |
| 3,859,976 | 1/1975 | McWhorter | 123/197.3 |
| 3,908,623 | 9/1975 | McWhorter | 123/197.2 |
| 4,211,190 | 7/1980 | Indech | 123/48 B |
| 4,463,710 | 8/1984 | McWhorter | 123/197.3 |
| 4,466,403 | 8/1984 | Menton | 123/197.4 |
| 4,802,382 | 2/1989 | Nissels | 123/197.3 |
| 5,060,603 | 10/1991 | Williams | 123/58 A |

*Primary Examiner*—Willis R. Wolfe
*Assistant Examiner*—M. Macy
*Attorney, Agent, or Firm*—Baker, Maxham, Jester & Meador

[57] ABSTRACT

A reciprocating piston internal combustion engine comprises a cylinder having opposed ends, a piston reciprocably mounted in the cylinder, a connecting rod having a crank journal end and a piston journal end, the connecting rod connected to the piston at the piston journal end by means for first and second wrist pins spaced longitudinally along the rod, the first wrist pin journaled in a bore in the piston and in a slot in the piston rod, and the second wrist pin journaled in a bore in the piston rod and a longitudinal slot in the piston.

19 Claims, 2 Drawing Sheets

DELAY STROKE PISTON AND ROD FOR ENGINE

BACKGROUND OF THE INVENTION

The present invention relates to internal combustion engines and pertains particularly to an improved delay stroke piston assembly for reciprocating piston engines.

The reciprocating piston internal combustion engine is the primary source of power for most automotive vehicles throughout the World today. The internal combustion engine has gained widespread use because of its many advantageous attributes which are well known. However, one of its main drawbacks, namely that of environmental pollution, raises the need for improvements in the combustion efficiency thereof.

The reciprocating piston internal combustion engine is manufactured in either two-stroke or four-stroke versions. The four-stroke engine is most widely used in the automobile. However, recent emphasis on economy and fuel efficiency has focused attention on the two stroke engine because of its higher horsepower to weight advantage. The two-stroke engine achieves this advantage because of its higher number of power strokes for a given revolution per minute (rpm). This advantage is largely outweighed by other disadvantages, primarily in the area of combustion and/or scavenging efficiency.

Federal regulations are imposing increasingly stricter standards for fuel efficiency and exhaust emissions on the automobile industry. Many ancillary systems have evolved for controlling pollutants by controlling spark and injection timing as well as exhaust gasses. The systems for controlling exhaust gasses typically increase cost and reduce the efficiency of the engine.

The piston in the four-stroke engine makes four strokes in the cylinder for each power stroke. The piston begins at top dead center (TDC) moving downward with an intake valve open to create a partial vacuum for drawing in a combustion charge. At the end of this stroke, the piston begins a compression stroke with all valves closed compressing the charge as the piston reaches top dead center. The fuel in the compressed charge is ignited as the piston reaches generally top dead center, and the rapidly burning (exploding) charge drives the piston down on the power stroke applying torque to the crankshaft. When the piston reaches bottom dead center (BDC), it begins an exhaust stroke as the exhaust valve opens, and drives the combustion waste from the cylinder as it moves to the top on the exhaust stroke.

Due to inefficiencies in the valves, pistons and associated combustion and scavenging dynamics, an absolute fresh intake charge is difficult to draw in. Similarly, for the same reason, a complete exhaust of the spent charge is difficult to achieve.

There exists a need for a two-stroke internal combustion engine having means for improving the intake and exhaust efficiency.

SUMMARY AND OBJECTS OF THE INVENTION

The present invention is directed to internal combustion engines and pertains particularly to an improved piston and rod assembly.

It is the primary object of the present invention to provide an improved two-stroke internal combustion engine having means for improving the intake and exhaust efficiency.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
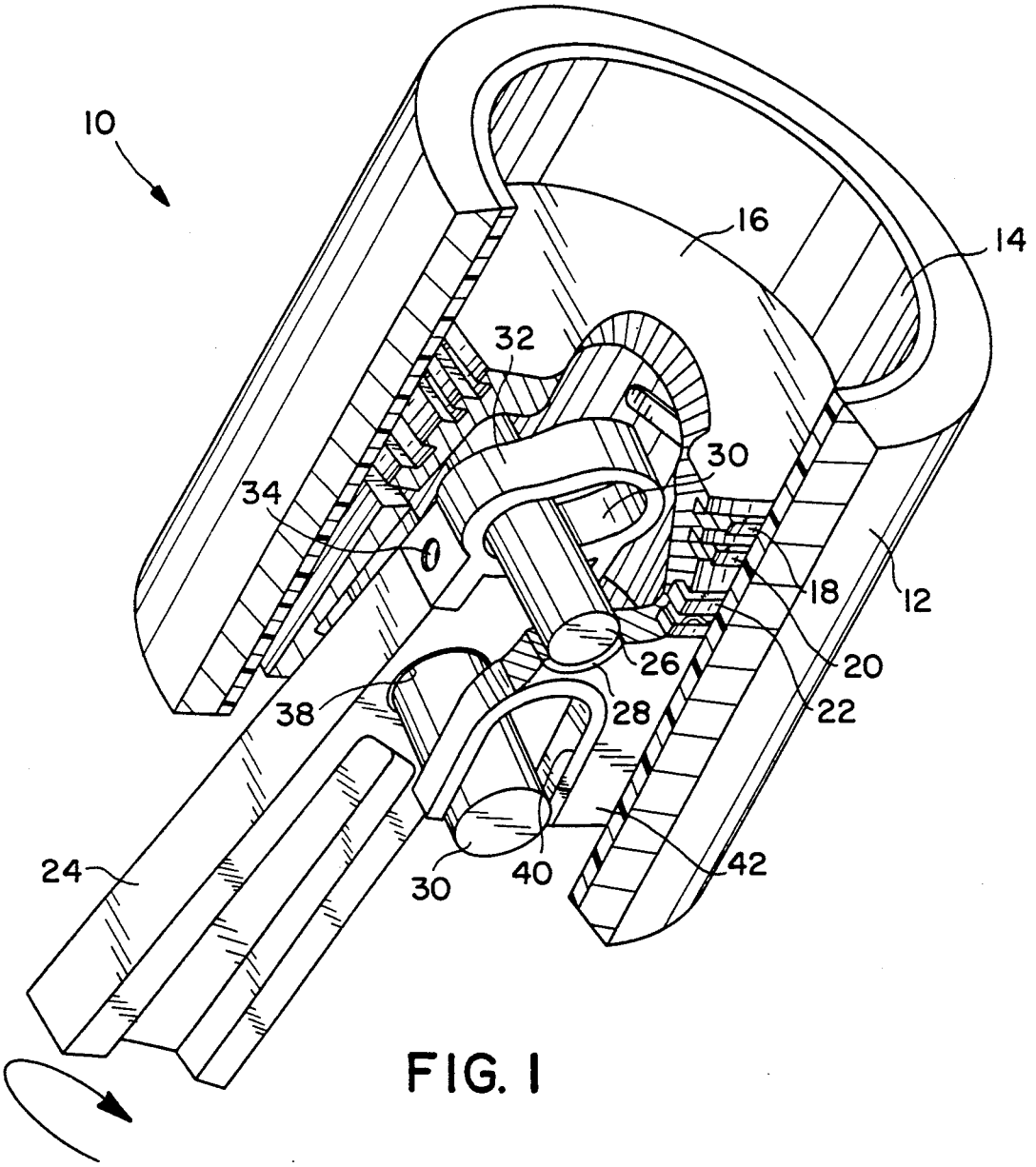
FIG. 1 is an isometric view partially in section illustrating a piston and connecting rod assembly in accordance with a preferred embodiment of the invention.

Referring to FIG. 1 of the drawing, there is illustrated a portion of a reciprocating piston internal combustion engine embodying an exemplary embodiment of a piston and connection rod assembly in accordance with a preferred embodiment of the invention. As illustrated in FIG. 1, a portion of an internal combustion engine is designated generally by the numeral 10 and comprises an engine block 12 having a bore in which is mounted a sleeve 14 defining a cylinder. A piston 16 having the usual generally cylindrical outer configuration for fitting within the cylinder 14 and having compression rings 18 and 20, with oil ring assembly 22, is reciprocably mounted within the cylinder 14.

For the sake of simplicity, the non-essential portions of the engine are not illustrated. The engine has a compression chamber above the piston 16 in which combustion occurs to drive the piston 16 downward for applying a force through the connecting rod to a crank arm of a crank shaft, not shown. The piston 16 is connected to a connecting rod 24 by a compound wrist pin connection, which is designed for establishing a delayed movement of the piston from bottom dead center position to provide increased time for scavenging of exhaust from the cylinder. It is contemplated that the present construction can be used in four-stroke engines, but is primarily designed for two cycle engines wherein the exhaust gases may be exhausted by natural flow or by means of a blower. However, for maximum efficiency, it will preferably be scavenged from the cylinder by means of a blower not shown.

In order to achieve this delayed movement of the piston at the bottom dead center position, the crank shaft is connected to the piston by means of a connecting rod having compound wrist pin connection to the piston. The compound wrist pin assembly comprises a first wrist pin 26 journaled in transverse aligned bores 28 in the piston, preferably proximate the center of the length thereof. This wrist pin engages and rides in an angled cam slot 30 at the outermost (combustion chamber) end of the connecting rod 24. The cam slot 30 is formed in a cam member 32, which may be formed in the outer end of the connecting rod or formed as a separate piece and secured by suitable means, such as bolts, cap screws or the like 34. The illustrated slot has an upper end 30*a* and a lower end 30*b* and is curved with a compound arc between the ends. The slot has a slight slope at the ends and a steep slope intermediate the ends. The effect of the slot cam is to lengthen or shorten the effective length of the connecting rod 24 during each stroke of the piston.

Figure 2:
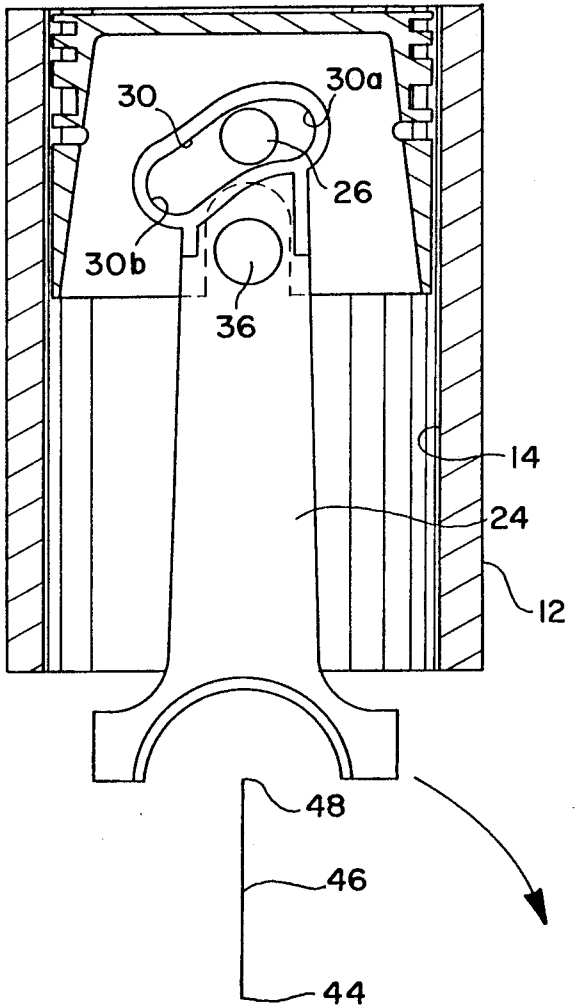
FIG. 2 is a a section view of the piston and connecting rod assembly of FIG. 1 shown in the top dead center position.

A second wrist pin 36 is journaled in a bore 38 adjacent the outer end of the connecting rod 24 and engages a pair of aligned longitudinally extending slots 40 formed in the lower skirt of the piston 16. The longitudinal slot or slots 40 are open at the bottom end and extend substantially parallel to the longitudinal axis of the piston 16. A crankshaft, schematically represented, is mounted in the engine block 12 for rotation about a journal 44, and includes a crank arm 46 with journal 48 to which the end of connecting rod 24 is connected. Upon rotary motion of the crank shaft in the clockwise direction, as illustrated in FIG. 2, when the piston and the crank reaches or approaches top dead center, the wrist pin 26 will be positioned close to the middle of the slot 30.

Figure 3:
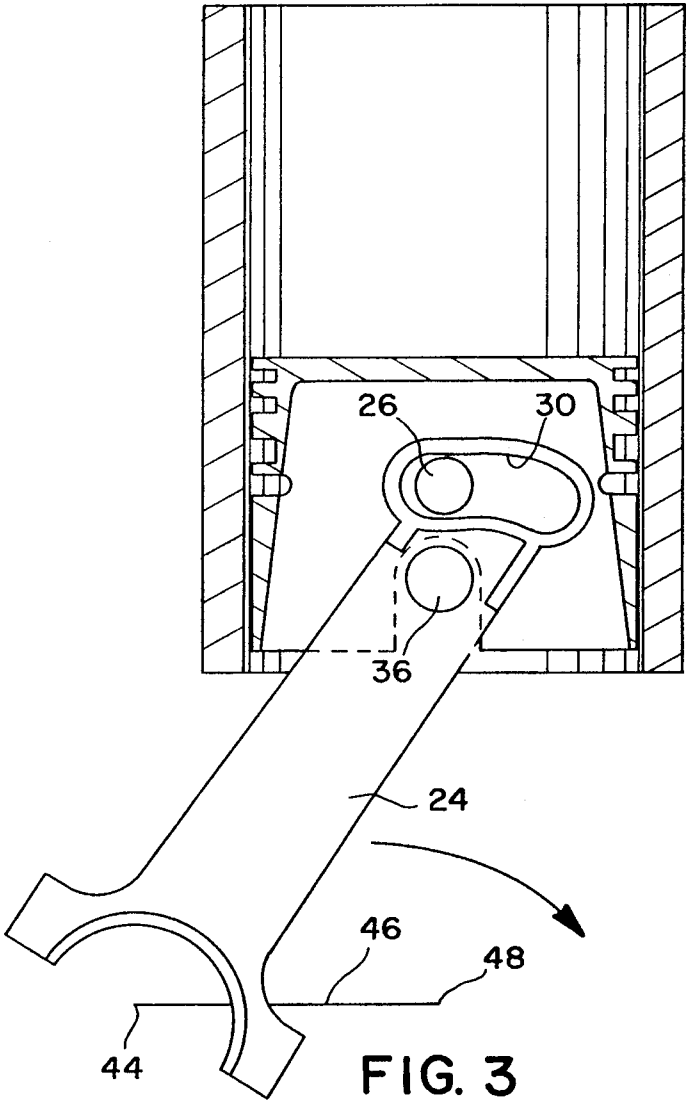
FIG. 3 is a view like FIG. 2 shown near the bottom dead center position.

As the crank begins to swing across the top of its arc, the connecting rod will pivot about the pin 36, forcing the pin 26 to ride upward in the slot 30, forcing the piston to move rapidly upward into the cylinder as the crank shaft reaches top dead center. As the crank shaft goes over top dead center, the upper end of connecting rod 24 will move to the left, allowing the pin to move substantially straight across in slot 30, and the piston to thereby move downward with the upper end of the connecting rod. As the crank shaft approaches bottom dead center, the pin 26 will be toward the upper end of the slot 30, and will begin the move downward in the slot to the center as the crank reaches bottom. The pin moves toward the lower left hand end of the slot as the crank shaft swings past the bottom dead center, thus allowing the piston to continue moving downward and hesitate at the bottom dead center position as the connecting rod begins to move upward with the crank shaft, as shown in FIG. 3. This provides a delayed movement of the piston or an extended dwell time at the bottom dead center position to extend the scavenging action of the cylinder. This also provides additional time at the bottom dead center position for charging of the cylinder with fresh combustion air or mixture.

While I have illustrated and described my invention by means of specific embodiments, it should be understood that numerous changes and modifications may be made therein without departing from the spirit and scope of the invention as defined in the appended claims.

I claim:

1. A reciprocating piston internal combustion engine, comprising:

a cylinder having a combustion chamber end and a crank shaft end;

a piston reciprocably mounted in said cylinder;

a rotary crankshaft;

a connecting rod having a crankshaft end connected to said crankshaft and a piston end connected to said piston; and compound connecting means at said piston end for connecting said piston end of said connecting rod to said piston for delayed movement of said piston from bottom dead center position, said compound connection comprises a first wrist pin journaled in a bore in one of said piston and connecting rod and in an angled slot having a compound curve including a steep slope intermediate the ends of said angled slot in the other of said piston and connection rod, and a second wrist pin journaled in a longitudinal slot in the one of said piston and connection rod and in a bore in the other of said piston and connecting rod.

2. A reciprocating piston internal combustion engine according to claim 1 wherein said angled slot is positioned relative to the direction of rotation of the engine so that the piston is cammed downward relative to the wrist pin as the crank passes bottom dead center and upward relative to the wrist pin as the crank passes top dead center.

3. A reciprocating piston internal combustion engine according to claim 1 wherein said first wrist pin is journaled in a bore in said piston and in an angled slot in an outer end of said piston rod, and said second wrist pin journaled in a bore adjacent said outer end in said piston rod and a longitudinal slot in a skirt of said piston.

4. A reciprocating piston internal combustion engine according to claim 1 wherein said first wrist pin in journaled in a bore in said piston and in an angled slot in said piston rod, and said second wrist pin journaled in a bore in said piston rod and a longitudinal slot in said piston.

5. A reciprocating piston internal combustion engine according to claim 4 wherein said angled slot is positioned relative to the direction of rotation of the engine so that the piston is cammed downward relative to the wrist pin as the crank passes bottom dead center and upward relative to the wrist pin as the crank passes top dead center.

6. A reciprocating piston internal combustion engine according to claim 1 wherein said angled slot is in the outermost end of said connecting rod.

7. A reciprocating piston internal combustion engine according to claim 6 wherein said angled slot is formed in a member detachably mounted on the outermost end of said connecting rod.

8. A reciprocating piston internal combustion engine, comprising:

a cylinder having a combustion chamber end and a crank shaft end;

a piston reciprocably mounted in said cylinder;

a connecting rod having a crank shaft end and a piston end;

said connecting rod connected to said piston at said piston end by means of a compound wrist pin connection enabling a delayed movement of said piston at the bottom end of the stroke;

said compound connection comprising a first wrist pin journaled in a bore in said piston and in an angled slot in said connecting rod; and a second wrist pin journaled in a bore in the piston end of said connecting rod and in a longitudinal slot in said piston.

9. A reciprocating piston internal combustion engine according to claim 8 wherein a center portion of said angled slot in said connecting rod is at an angle of about forty-five degrees to said connecting rod.

10. A reciprocating piston internal combustion engine according to claim 8 wherein said angled slot is formed in a member detachably mounted on the outermost end of said connecting rod.

11. A reciprocating piston internal combustion engine, comprising:

a cylinder having a combustion chamber end and a crank shaft end;

a piston reciprocably mounted in said cylinder;

a connecting rod having a crank shaft end and a piston end;

said connecting rod connected to said piston at said piston end by means of a compound wrist pin connection enabling a delayed movement of said piston at the bottom end of the stroke;

said compound connection comprising a first wrist pin journaled in a bore in said piston and in an angled slot in an outer end of said connection rod; and a second wrist pin journaled in a bore in said connection rod and in a longitudinal slot in a skirt of said piston, wherein said slot has a slight slope at the ends and a steep slope of about forty-five degrees intermediate the ends.

12. A reciprocating piston internal combustion engine according to claim 11 wherein said angled slot is in the outermost end of said connecting rod.

13. A reciprocating piston internal combustion engine according to claim 12 wherein said angled slot is formed in a member detachably mounted on the outermost end of said connecting rod.

14. A reciprocating piston internal combustion engine, comprising:

an engine block having at least one cylinder having a combustion chamber end and a crank shaft end;

a crankshaft rotatably mounted in said engine block and having a crank journal;

a piston reciprocably mounted in said cylinder;

a connecting rod having an end connected to said crank journal of said crankshaft and a piston end connected to said piston;

said connecting rod connected to said piston at said piston end by means of a compound wrist pin connection enabling a delayed movement of said piston at the bottom end of the stroke;

said compound connection comprising a first wrist pine journaled in a bore in one of said piston and connecting rod and in an angled slot in the other of said piston and connection rod; and a second wrist pine journaled in a bore in the other of said piston and connection rod and in a longitudinal slot in the one of said piston and connecting rod, wherein said slot has a slight slope at the ends and a steep slope intermediate the ends.

15. A reciprocating piston internal combustion engine according to claim 14 wherein said first wrist pin is journaled in a bore in said piston and an angled slot in said connecting rod.

16. A reciprocating piston internal combustion engine according to claim 14 wherein said second wrist pin is journaled in a bore in said connecting rod and a longitudinal slot in said piston.

17. A reciprocating piston internal combustion engine according to claim 14 wherein said first wrist pin is journaled in a transverse bore in said piston and an angled slot in an outer end of said connecting rod, and said second wrist pin is journaled in a bore adjacent said outer end in said connecting rod and a longitudinal slot in a skirt of said piston.

18. A reciprocating piston internal combustion engine according to claim 14 wherein said angled slot is in the outermost end of said connecting rod.

19. A reciprocating piston internal combustion engine according to claim 18 wherein said angled slot is formed in a member detachably mounted on the outermost end of said connecting rod.

* * * * *